US011781573B2

(12) United States Patent
Slattery

(10) Patent No.: US 11,781,573 B2
(45) Date of Patent: Oct. 10, 2023

(54) SYSTEM, VALVE ASSEMBLY, AND METHODS FOR OSCILLATION CONTROL OF A HYDRAULIC MACHINE

(71) Applicant: Parker-Hannifin Corporation, Cleveland, OH (US)

(72) Inventor: Brian B. Slattery, Hicksville, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 344 days.

(21) Appl. No.: 17/308,120

(22) Filed: May 5, 2021

(65) Prior Publication Data

US 2022/0025914 A1 Jan. 27, 2022

Related U.S. Application Data

(60) Provisional application No. 63/075,400, filed on Sep. 8, 2020, provisional application No. 63/055,615, filed on Jul. 23, 2020.

(51) Int. Cl.
*F15B 21/12* (2006.01)
*F15B 1/033* (2006.01)
(Continued)

(52) U.S. Cl.
CPC ..... *F15B 21/12* (2013.01); *F15B 1/033* (2013.01); *F15B 15/202* (2013.01);
(Continued)

(58) Field of Classification Search
CPC ..... F15B 21/12; F15B 1/033; F15B 1/021; F15B 15/202; F15B 2201/411;
(Continued)

(56) References Cited

U.S. PATENT DOCUMENTS 4,293,000 A * 10/1981 Budzich ..... F15B 11/165 137/596.1
4,543,875 A * 10/1985 Imhof ..... F15B 13/0436 91/461

(Continued)

FOREIGN PATENT DOCUMENTS

DE 102012208307 A1 11/2013
DE 10 2017 008359 A1 3/2019
DE 10 2018 210471 B3 9/2019

OTHER PUBLICATIONS

Extended European Search Report prepared by the European Patent Office in application No. EP 21 18 5243.9 dated Dec. 23, 2021.

(Continued)

*Primary Examiner* — Minh Q Le
(74) *Attorney, Agent, or Firm* — McDonnell Boehnen Hulbert & Berghoff LLP

(57) ABSTRACT

An example valve assembly includes a housing having an accumulator fluid passage configured to be fluidly coupled to an accumulator, a supply fluid cavity configured to be fluidly coupled to a source of fluid, a reservoir fluid cavity configured to be fluidly coupled to a reservoir of fluid, a head fluid cavity configured to be fluidly coupled to a head-side chamber of a hydraulic actuator, and a rod fluid cavity configured to be fluidly coupled to a rod-side chamber of the hydraulic actuator; a main spool that is axially-movable within the housing; and a balancing spool that is axially-movable within the housing based on an axial position of the main spool.

20 Claims, 5 Drawing Sheets

(51) Int. Cl.

| | |
|---|---|
| ***F15B 15/20*** | (2006.01) |
| *F15B 1/02* | (2006.01) |
| *F15B 21/08* | (2006.01) |
| *F15B 13/04* | (2006.01) |
| *F15B 13/043* | (2006.01) |
| *E02F 9/22* | (2006.01) |

(52) U.S. Cl.
CPC ..... *E02F 9/2207* (2013.01); *F15B 1/021* (2013.01); *F15B 13/0402* (2013.01); *F15B 13/0433* (2013.01); *F15B 21/082* (2013.01); *F15B 2201/411* (2013.01); *F15B 2211/30535* (2013.01); *F15B 2211/3122* (2013.01); *F15B 2211/3144* (2013.01); *F15B 2211/329* (2013.01); *F15B 2211/625* (2013.01); *F15B 2211/7053* (2013.01); *F15B 2211/8613* (2013.01)

(58) Field of Classification Search
CPC ..... F15B 21/082; F15B 13/0433; F15B 13/0402; F15B 2211/30535; F15B 2211/3122; F15B 2211/3144; F15B 2211/329; F15B 2211/625; F15B 2211/7053; F15B 2211/8613; E02F 9/2207
USPC ..... 137/624.14; 91/178, 378, 529, 465; 60/469
See application file for complete search history.

(56) References Cited

U.S. PATENT DOCUMENTS

| | | | | |
|---|---|---|---|---|
| 5,706,657 | A | 1/1998 | Amborski et al. | |
| 5,752,426 | A * | 5/1998 | Ikei | E02F 9/2267 137/596.2 |
| 5,802,847 | A * | 9/1998 | Harnischfeger | E02F 9/2217 60/494 |
| 5,921,279 | A * | 7/1999 | Barber | F15B 13/0402 91/464 |
| 5,992,146 | A | 11/1999 | Hausman | |
| 6,167,701 | B1 | 1/2001 | Hatcher et al. | |
| 6,192,937 | B1 * | 2/2001 | Fagerlie | F15B 13/0431 137/625.63 |
| 6,279,316 | B1 | 8/2001 | Vigholm | |
| 6,938,413 | B2 * | 9/2005 | Harnischfeger | F15B 1/021 60/413 |
| 8,162,070 | B2 | 4/2012 | Smith et al. | |
| 8,307,641 | B2 * | 11/2012 | Hanks | E02F 9/2207 60/416 |
| 9,732,500 | B2 | 8/2017 | Harsia et al. | |
| 2007/0056277 | A1 | 3/2007 | Mizoguchi et al. | |
| 2010/0320406 | A1 * | 12/2010 | Matsuo | G05D 7/0635 251/129.01 |
| 2012/0205565 | A1 * | 8/2012 | Balmonet | F15B 13/0433 251/25 |
| 2016/0363227 | A1 * | 12/2016 | Sensabaugh | F16K 11/07 |
| 2017/0328380 | A1 * | 11/2017 | Coolidge | F15B 13/0417 |
| 2018/0112375 | A1 | 4/2018 | Greer | |
| 2018/0266447 | A1 * | 9/2018 | Imam | F15B 7/10 |
| 2020/0124060 | A1 * | 4/2020 | Yuan | F15B 13/029 |
| 2020/0263392 | A1 * | 8/2020 | Ito | E02F 9/22 |
| 2021/0310570 | A1 * | 10/2021 | Kashid | F15B 13/0402 |
| 2021/0381573 | A1 * | 12/2021 | Christenson | B64C 25/505 |

OTHER PUBLICATIONS

Hydraulic-master.com, "2 spool hydraulic valve is a device used to control hydraulic systems", retrieved from the Internet: https://www.hydraulic-master.com/blog/2-spool-hydraulic-control-valve-n26 on Aug. 5, 2020.

* cited by examiner

SYSTEM, VALVE ASSEMBLY, AND METHODS FOR OSCILLATION CONTROL OF A HYDRAULIC MACHINE

CROSS REFERENCE TO RELATED APPLICATION

The present application claims priority to U.S. Provisional Application No. 63/055,615 filed on Jul. 23, 2020 and U.S. Provisional Application No. 63/075,400 filed on Sep. 8, 2020, the entire contents of all of which are herein incorporated by reference as if fully set forth in this description.

BACKGROUND

A hydraulic machine can have several hydraulic actuators configured to enable the machine to perform several operations. For example, a wheel loader may have a hydraulic actuator configured to control movement of a bucket, with the bucket being supported by a boom structure (e.g., two arms coupling the bucket to the chassis of the wheel loader). Motion of the boom structure is enabled by one or more hydraulic actuators.

Such a hydraulic machine can be subjected to oscillation when operated on an uneven, bumpy road. Such oscillation makes riding the machine uncomfortable and can lead spillage from the bucket, for example.

Therefore, it may be desirable to have a system and valve assembly that limits or controls such oscillations. It may also be desirable to implement such system and valve assembly in a way as to provide a more efficient system overall than would be achieved without such system and valve assembly. It is with respect to these and other considerations that the disclosure made herein is presented.

SUMMARY

The present disclosure describes implementations that relate to system, valve assembly, and methods for oscillation control of a hydraulic machine.

In a first example implementation, the present disclosure describes a valve assembly. The valve assembly includes: (i) a housing comprising: an accumulator fluid passage configured to be fluidly coupled to an accumulator, a supply fluid cavity configured to be fluidly coupled to a source of fluid, a reservoir fluid cavity configured to be fluidly coupled to a reservoir of fluid, a head fluid cavity configured to be fluidly coupled to a head-side chamber of a hydraulic actuator, and a rod fluid cavity configured to be fluidly coupled to a rod-side chamber of the hydraulic actuator; (ii) a main spool that is axially-movable within the housing between an unactuated axial position, a first axial position, and a second axial position; and (iii) a balancing spool that is axially-movable within the housing based on an axial position of the main spool, wherein (a) when the main spool is at the unactuated axial position, the balancing spool allows the supply fluid cavity to be fluidly coupled to the accumulator fluid passage, (b) when the main spool is at the first axial position, the balancing spool is subjected to opposing fluid forces by fluid from the head fluid cavity and fluid from the accumulator fluid passage, thereby causing pressure level in the accumulator fluid passage to be balanced with pressure level in the head fluid cavity, and (c) when the main spool is at the second axial position, the main spool allows the accumulator fluid passage to be fluidly coupled to the head fluid cavity and the rod fluid cavity to be fluidly coupled to the reservoir fluid cavity.

In a second example implementation, the present disclosure describes a hydraulic system. The hydraulic system includes: a source of fluid, a reservoir of fluid, a hydraulic cylinder actuator having a head-side chamber and a rod-side chamber, an accumulator, and a valve assembly. The valve assembly includes: (i) a housing comprising an accumulator fluid passage fluidly coupled to the accumulator, a supply fluid cavity fluidly coupled to the source of fluid, a reservoir fluid cavity fluidly coupled to the reservoir of fluid, a head fluid cavity configured to be fluidly coupled to the head-side chamber, and a rod fluid cavity configured to be fluidly coupled to the rod-side chamber; (ii) a main spool that is axially-movable within the housing between an unactuated axial position, a first axial position, and a second axial position; and (iii) a balancing spool that is axially-movable within the housing based on an axial position of the main spool, wherein (a) when the main spool is at the unactuated axial position, the balancing spool allows the supply fluid cavity to be fluidly coupled to the accumulator fluid passage, (b) when the main spool is at the first axial position, the balancing spool is subjected to opposing fluid forces by fluid from the head fluid cavity and fluid from the accumulator fluid passage, thereby causing pressure level of the accumulator to be balanced with pressure level in the head-side chamber, and (c) when the main spool is at the second axial position, the main spool allows the accumulator fluid passage to be fluidly coupled to the head fluid cavity and the rod fluid cavity to be fluidly coupled to the reservoir fluid cavity.

In a third example implementation, the present disclosure describes a method. The method includes: (i) operating a valve assembly in an unactuated state, wherein the valve assembly comprises: (a) a housing having: an accumulator fluid passage fluidly coupled to an accumulator, a supply fluid cavity fluidly coupled to a source of fluid, a reservoir fluid cavity fluidly coupled to a reservoir of fluid, a head fluid cavity configured to be fluidly coupled to a head-side chamber of a hydraulic actuator, and a rod fluid cavity configured to be fluidly coupled to a rod-side chamber of the hydraulic actuator, (b) a main spool that is axially-movable within the housing, and (c) a balancing spool that is axially-movable within the housing based on an axial position of the main spool, wherein operating the valve assembly in the unactuated state comprises the main spool being at an unactuated axial position, causing the balancing spool to allow the supply fluid cavity to be fluidly coupled to the accumulator fluid passage; (ii) operating the valve assembly in a first actuated state, wherein the main spool moves to a first axial position, causing the balancing spool to be subjected to opposing fluid forces by fluid from the head fluid cavity and fluid from the accumulator fluid passage, thereby causing pressure level of the accumulator to be balanced with pressure level in the head-side chamber; and (iii) operating the valve assembly in a second actuated state, wherein the main spool moves to a second axial position, causing the accumulator fluid passage to be fluidly coupled to the head fluid cavity and the rod fluid cavity to be fluidly coupled to the reservoir fluid cavity.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

Hydraulic machinery (e.g., a wheel loader or skid steer) includes a hydraulic system configured to control fluid flow to hydraulic actuators. Particularly, the hydraulic system can include a source of fluid, such as a pump, configured to provide fluid flow at a particular pressure level to the hydraulic actuators through a valve to cause the hydraulic actuators to move.

Figure 1:
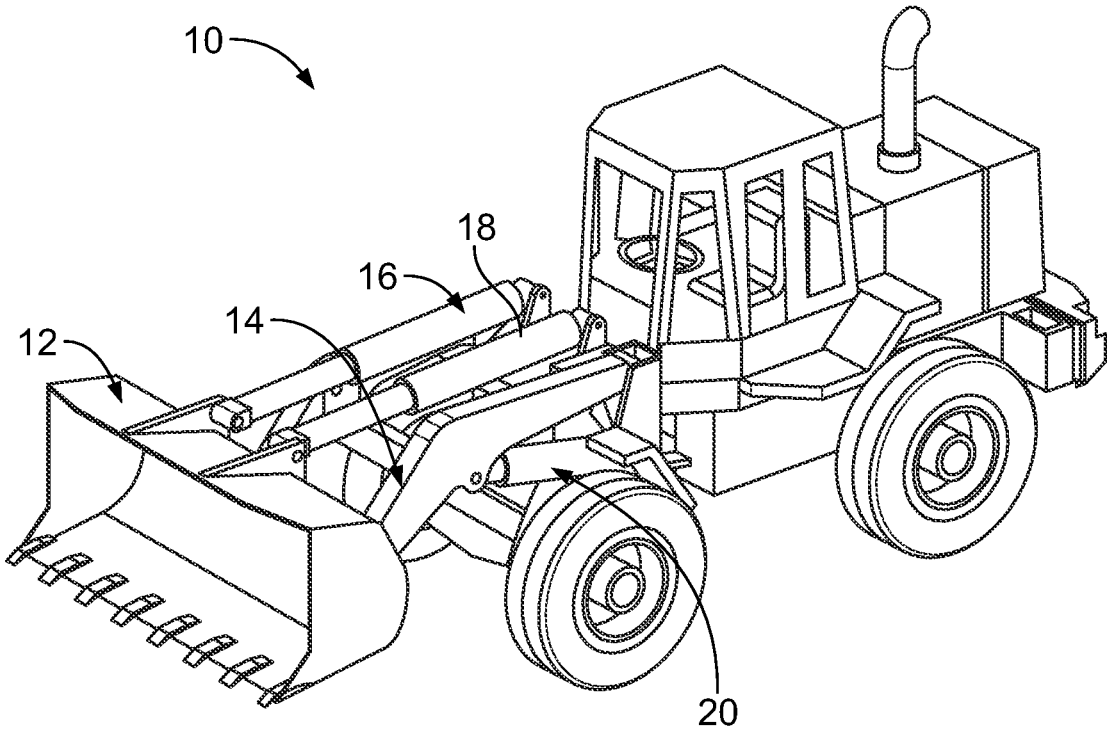
FIG. 1 illustrates a wheel loader as an example hydraulic machine, in accordance with an example implementation.

FIG. 1 illustrates a wheel loader 10 as an example hydraulic machine, in accordance with an example implementation. The wheel loader 10 includes a bucket 12 coupled to a boom 14, which is attached to a frame of the wheel loader 10. The bucket 12 is movable by one or more hydraulic cylinder actuators such as bucket actuator 16 and bucket actuator 18 configured to curl and uncurl the bucket 12. The boom 14 can be lifted and lowered by one or more hydraulic cylinder actuators such as boom actuator 20 (the wheel loader 10 can include another boom actuator on the other side thereof actuated in tandem with the boom actuator 20 to lift and lower the boom 14).

Figure 2:
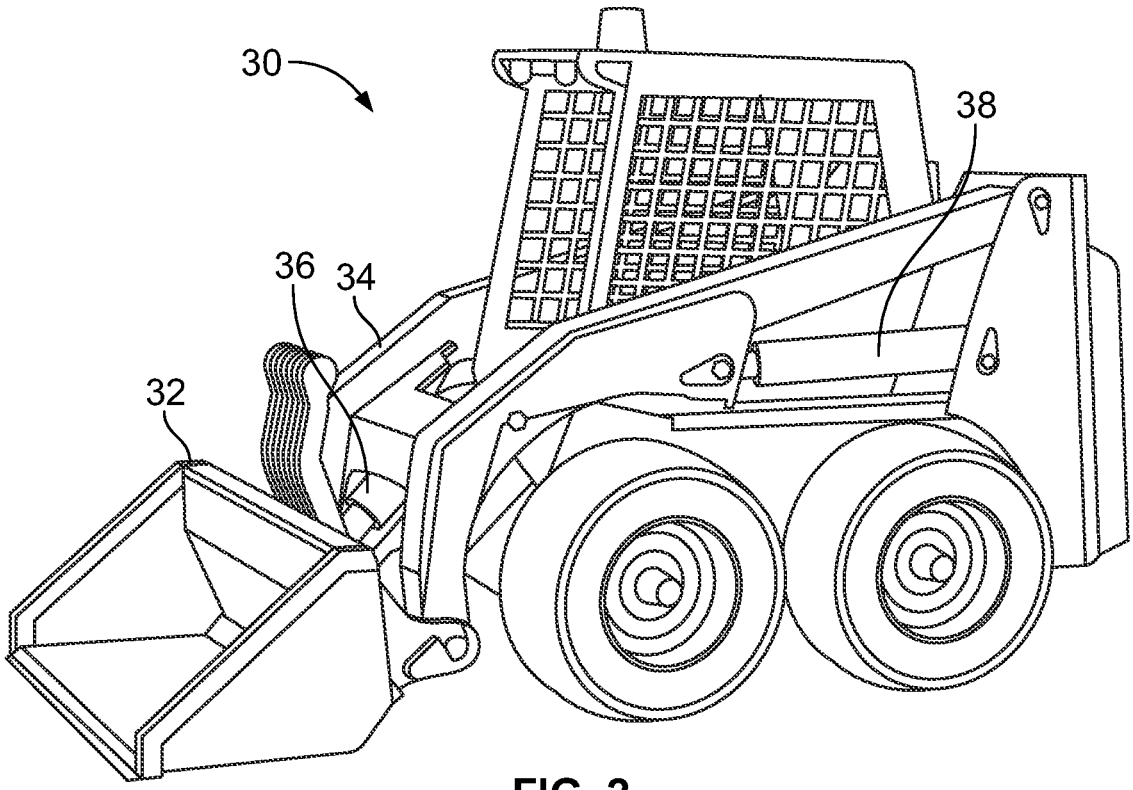
FIG. 2 illustrates a skid steer as another example hydraulic machine, in accordance with an example implementation.

FIG. 2 illustrates a skid steer 30 as another example hydraulic machine, in accordance with an example implementation. The skid steer 30 includes a bucket 32 coupled to a boom 34, which is attached to a frame of the skid steer 30. The bucket 32 is movable by one or more hydraulic cylinder actuators such as bucket actuator 36 configured to curl and uncurl the bucket 32. The boom 34 can be lifted and lowered by one or more hydraulic cylinder actuators such as boom actuator 38 (the skid steer 30 can include another boom actuator on the other side thereof actuated in tandem with the boom actuator 38 to lift and lower the boom 34).

When a hydraulic machine, such as the wheel loader 10 or the skid steer 30, operates on uneven ground, the entire machine can oscillate. For example, as the wheel loader 10 goes over a bump, the weight from the bucket 12 shifts up and down as a piston of the boom actuator 20 oscillate back and forth, which causes the entire machine to oscillate. Without oscillation control, to prevent material from spilling out of the bucket 12, the wheel loader 10 would proceed slowly on a bumpy road, which may be undesirable as it slows down site operations. Limiting oscillations of the boom actuator 20 can render operating the wheel loader 10 more comfortable to the operator, can reduce stress on the wheel loader 10, can save time as the wheel loader 10 might proceed with a relatively high speed, and can prevent spillage from the bucket 12.

Disclosed herein are a hydraulic system, valve assembly, and a method that, among other features, provide oscillation control for a hydraulic machine. Further, the configurations disclosed herein provide such oscillation control features in a cost-efficient manner where a single solenoid valve is used to control movement of two spools, as opposed to using a separate solenoid valve for each spool. The wheel loader 10 and the skid steer 30 are used herein as example hydraulic machines. It should be understood that the system, valve assembly, and method disclosed herein are applicable to other types of hydraulic machines (e.g., an excavator).

Figure 3:
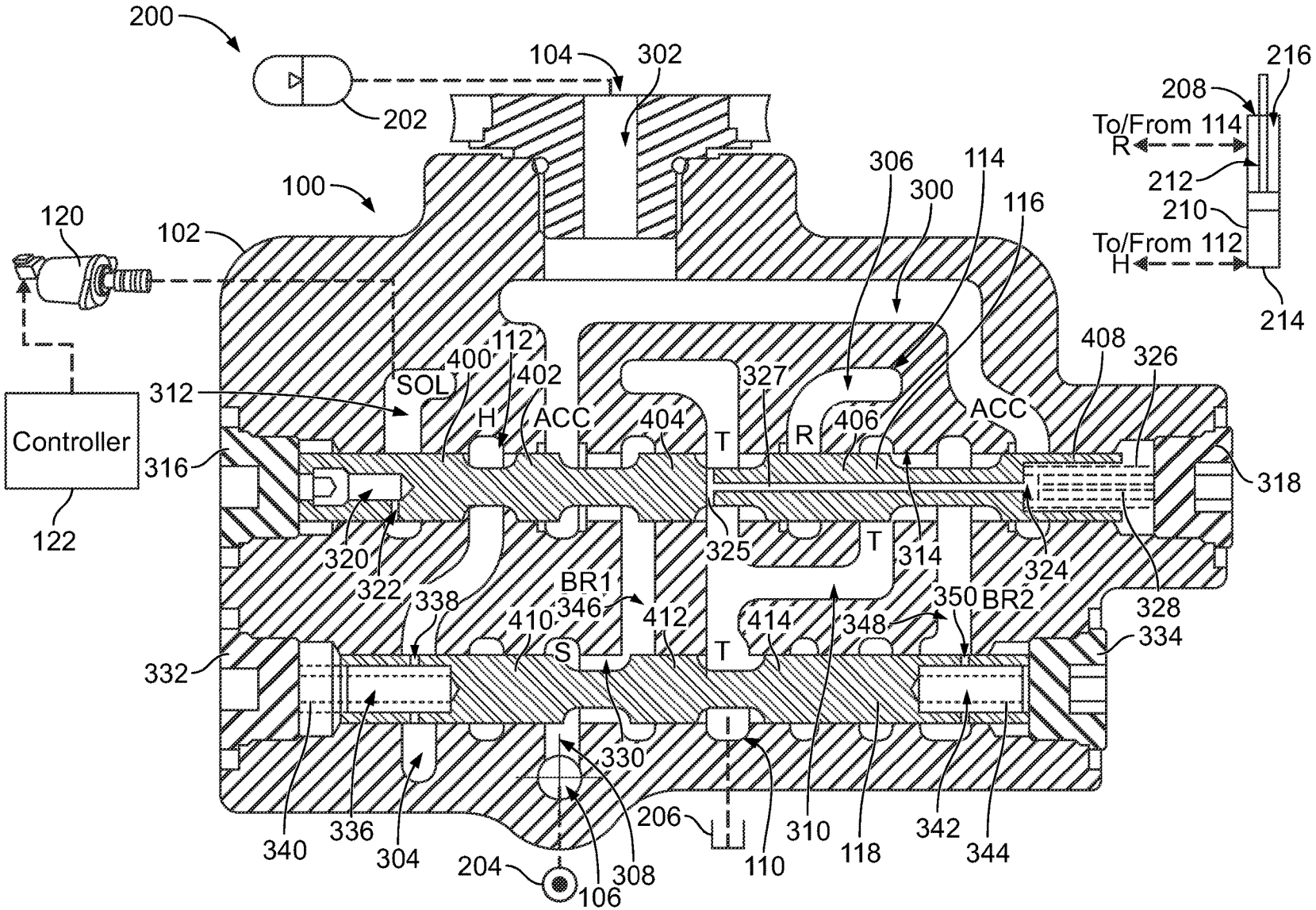
FIG. 3 illustrates a hydraulic system and a cross-sectional view of a valve assembly of the hydraulic system when the valve assembly is in an unactuated state, in accordance with an example implementation.

FIG. 3 illustrates a hydraulic system 200 and a cross-sectional view of a valve assembly 100 of the hydraulic system 200 when the valve assembly 100 is in an unactuated state, in accordance with an example implementation. The valve assembly 100 includes a housing 102. The housing 102 can be referred to as a valve body and can, for example, be made as a metal casting. The housing 102 includes various ports configured to receive and provide fluid therethrough. For example, the housing 102 includes an accumulator port 104 configured to be fluidly coupled to an accumulator 202.

The housing 102 also includes a supply port 106 configured to be fluidly coupled to a source 204 of fluid. The source 204 of fluid can, for example, be a pump (e.g., a gear pump, a piston pump, a variable displacement load-sensing pump, etc.). The source 204 is configured to provide pressurized fluid to the valve assembly 100, e.g., fluid at pressure levels of up to 3000-5000 pounds per square inch (psi). The housing 102 further includes a tank port or reservoir port 110 configured to be fluidly coupled to a reservoir 206 containing low pressure fluid (e.g., fluid having pressure level of 0-70 psi).

The hydraulic machine (e.g., the wheel loader 10 or the skid steer 30) that includes the hydraulic system 200 can include one more actuators including hydraulic cylinder actuators, hydraulic motor actuators, etc. As an example for illustration, the wheel loader 10 includes the bucket actuators 16, 18 configured as bucket hydraulic cylinder actuators controlling movement of the bucket 12 of the wheel loader 10. The wheel loader 10 also includes one or more boom hydraulic cylinder actuators, such as the boom actuator 20, configured to lift or lower the bucket 12 of the wheel loader 10. If the wheel loader 10 includes two boom hydraulic cylinder actuators, the actuators are actuated in tandem (e.g., in the same direction) to lift or lower the bucket 12 of the wheel loader 10.

The hydraulic system 200 depicts a hydraulic cylinder actuator 208. The hydraulic cylinder actuator 208 represents, for example, the boom actuator 20 or the boom actuator 38 described above. Although the hydraulic system 200 depicts one boom hydraulic cylinder actuator, it should be understood that the hydraulic system 200 can include another boom hydraulic cylinder actuator working in tandem with the hydraulic cylinder actuator 208 where the respective chambers of both actuators are fluidly coupled to teach other.

The hydraulic cylinder actuator 208 includes a cylinder 210 and a piston 212 slidably accommodated within the cylinder 210. The piston 212 has a piston head and a piston rod, and the piston head divides the internal space of the cylinder 210 into a cap or head-side chamber 214 and a rod-side chamber 216.

The housing 102 includes a head port 112 configured to be fluidly coupled to the head-side chamber 214 of the hydraulic cylinder actuator 208. The housing 102 also includes a rod port 114 configured to be fluidly coupled to the rod-side chamber 216 of the hydraulic cylinder actuator 208.

The valve assembly 100 further includes a main spool 116 and a balancing spool 118. The housing 102 includes spool bores configured to slidably accommodate the main spool 116 and the balancing spool 118 such that the main spool 116 and the balancing spool 118 are axially-movable within their respective bores as described below.

The hydraulic system further includes a solenoid valve 120 that is configured to be coupled to the housing 102 of the valve assembly 100. The solenoid valve 120 is electrically-actuated. For example, the hydraulic system 200 or the hydraulic machine includes a controller 122 configured to provide electric signals to the solenoid valve 120 based on input signals (e.g., operator commands or commands from a main controller of a hydraulic machine). The controller 122 is an electronic controller that includes one or more processors or microprocessors and may include data storage (e.g., memory, transitory computer-readable medium, non-transitory computer-readable medium, etc.). The data storage may have stored thereon instructions that, when executed by the one or more processors of the controller 122, cause the controller 122 to perform operations described herein.

When actuated by the controller 122, the solenoid valve 120 provides a fluid pressure signal that shifts the main spool 116 within its spool bore inside the housing 102. As described below, shifting the main spool 116 also controls axial position of the balancing spool 118 within its respective bore, and thus the solenoid valve 120 controls axial positions of both the main spool 116 and the balancing spool 118.

The hydraulic system 200 is configured to dampen oscillations of the hydraulic cylinder actuator 208. Particularly, the valve assembly 100 and the accumulator 202 can be used to dampen changes in the force applied to the hydraulic cylinder actuator 208. The accumulator 202 is a pressure storage reservoir in which hydraulic fluid is held under pressure that is applied by an external source. The external source can be a spring or compressed gas, as examples. For instance, the accumulator 202 can include compressible gas (e.g., nitrogen) therein and an elastic diaphragm or a piston, which separates the hydraulic fluid from a section of compressed gas beneath.

While hydraulic fluid is incapable of being substantially compressed under force, gas can be compressed, and can thus absorb kinetic energy or shocks that the piston 212 may be subjected to. The valve assembly 100 can provide fluid restrictions that operate to dampen motion of the piston 212. As such, the valve assembly 100 and the accumulator 202 can operate as a shock absorber that dampens oscillations of the piston 212 of the hydraulic cylinder actuator 208.

Particularly, the valve assembly 100 is configured to provide several oscillation control features. The valve assembly 100 is configured to provide a connection between the source 204 of fluid (e.g., the pump) and the accumulator 202 so as to allow charging the accumulator with high pressure fluid. Further, the valve assembly 100 is configured to provide a fluid connection between the accumulator 202 and the head-side chamber 214 of the hydraulic cylinder actuator 208 via a fluid restriction to absorb and dampen oscillations of the piston 212.

Notably, if the pressure level of fluid in the head-side chamber 214 is higher than the pressure level of the accumulator 202, the piston 212 may retract (e.g., move downward in FIG. 2) unintentionally, causing the bucket of a wheel loader to be lowered unintentionally, for example. On the other hand, if the pressure level of the accumulator 202 is higher than the pressure level in the head-side chamber 214, the piston 212 may extend (e.g., move upward in FIG. 2) unintentionally, causing the bucket to be raised unintentionally. As such, the valve assembly 100 is configured to balance or equalize pressure level of fluid at the head-side chamber 214 and the pressure level of fluid in the accumulator 202 prior to connecting the head-side chamber 214 to the accumulator 202. Such pressure balance can prevent unintentional or undesired movement of the piston 212.

Figure 4:
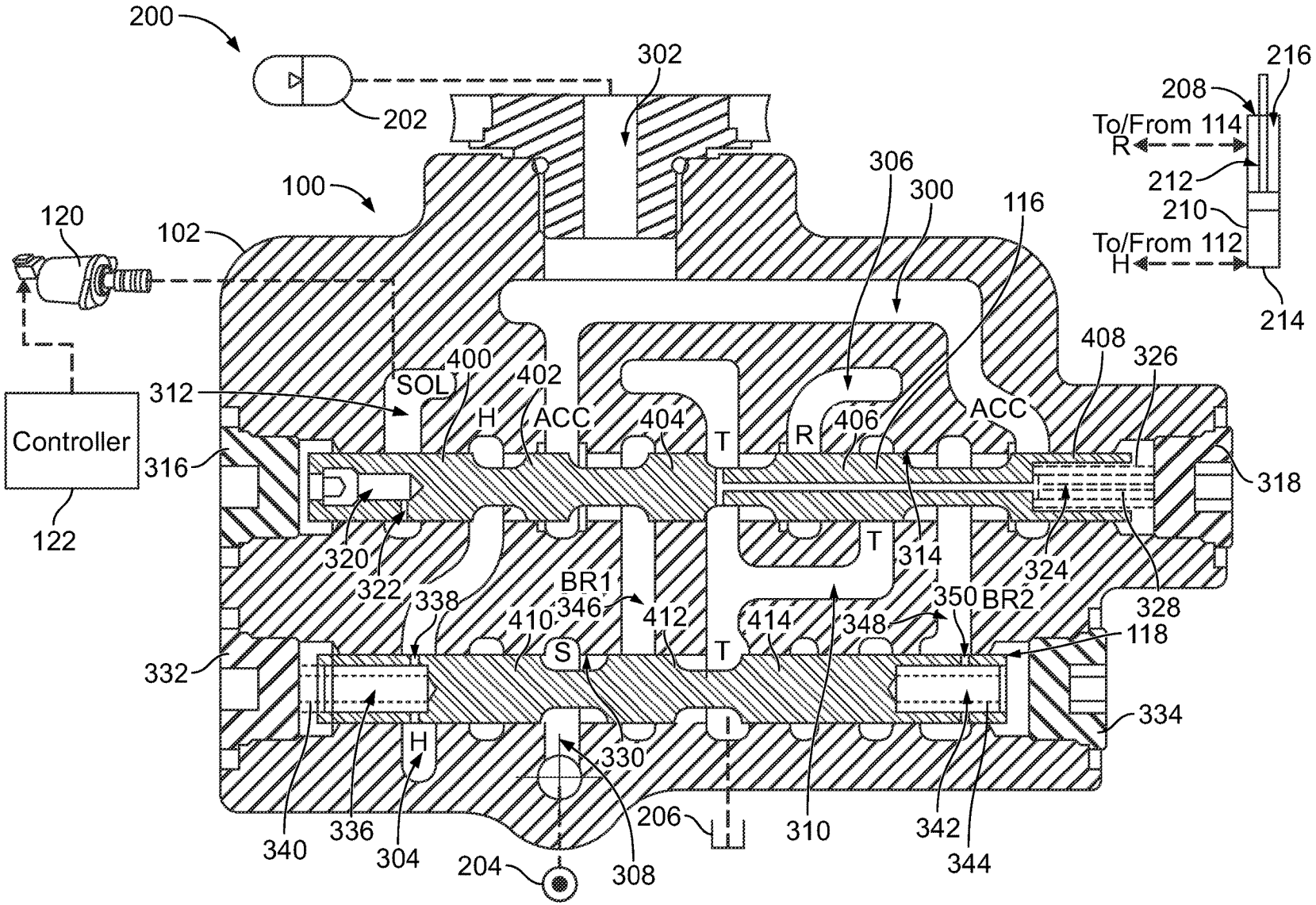
FIG. 4 illustrates a cross-sectional view of the valve assembly of FIG. 3 when the valve assembly is actuated to a first actuated state, in accordance with an example implementation.
Figure 5:
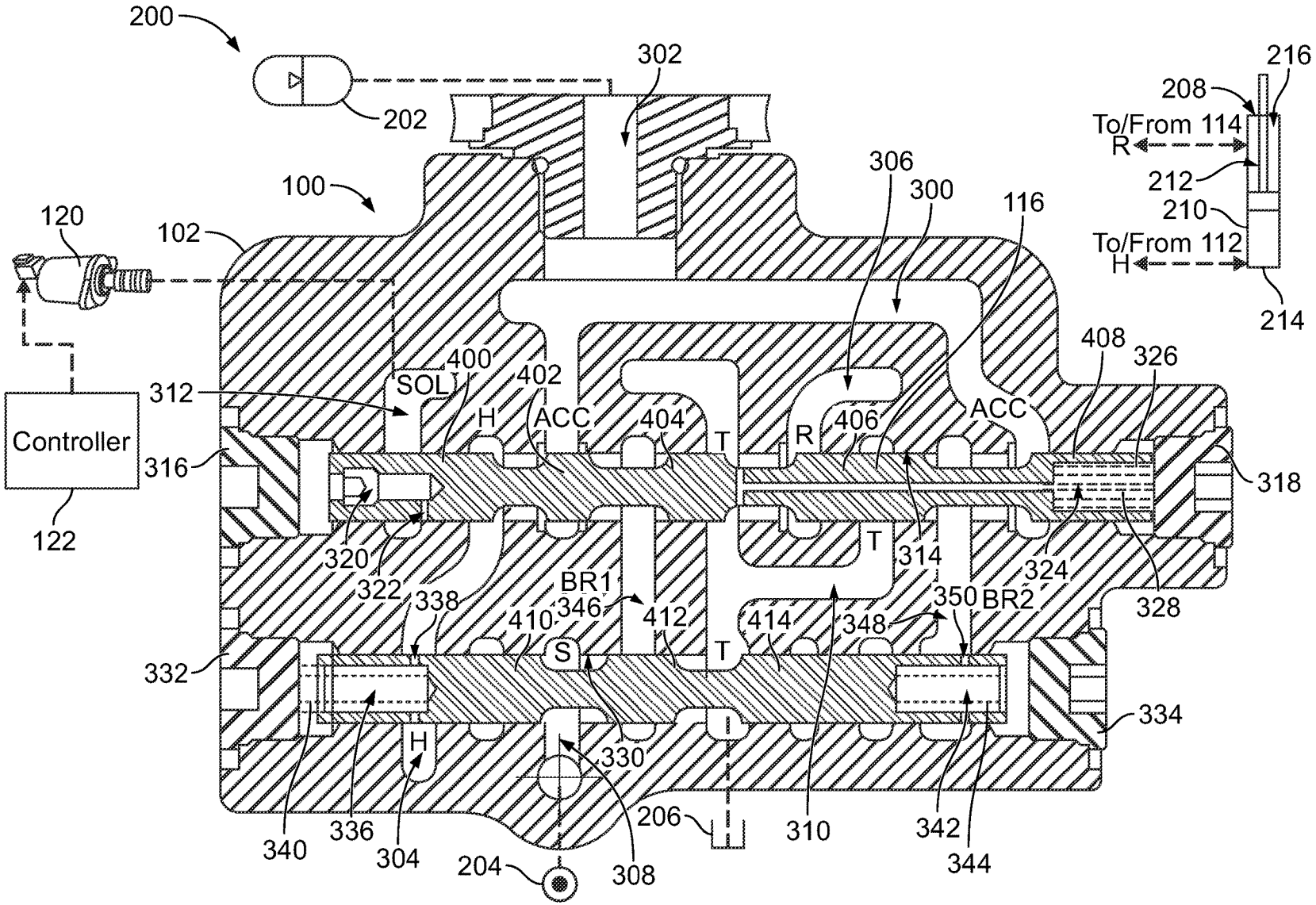
FIG. 5 illustrates a cross-sectional view of the valve assembly of FIG. 3 when the valve assembly is actuated to a second actuated state, in accordance with an example implementation.

The valve assembly 100 is further configured to provide a fluid connection between the rod-side chamber 216 and the reservoir 206 to lower pressure level in the rod-side chamber 216 of the hydraulic cylinder actuator 208 and allow the piston 212 to move as the valve assembly 100 and the accumulator 202 dampen its motion. FIGS. 3-5 illustrate an example configuration of the valve assembly 100 that accomplishes the aforementioned oscillation control features.

The housing 102 includes various fluid passages for transfer of fluid therein. As shown in FIG. 3, the valve assembly 100 includes an accumulator fluid passage 300 (labelled "ACC") configured to be fluidly coupled to the accumulator 202 via fluid passage 302. The accumulator fluid passage 300 is configured as a double- or dual-wing passage straddling a center passage that is in fluid communication with the fluid passage 302.

The valve assembly 100 also includes a head fluid cavity 304 (labelled "H") that is configured to be fluidly coupled to the head-side chamber 214 of the hydraulic cylinder actuator 208 via the head port 112. The valve assembly 100 also includes a rod fluid cavity 306 (labelled "R") that is configured to be fluidly coupled to the rod-side chamber 216 of the hydraulic cylinder actuator 208 via the rod port 114.

The valve assembly 100 further includes a supply fluid cavity 308 (labelled "S") that is configured to be fluidly coupled to the source 204 of fluid via the supply port 106. The valve assembly 100 also includes a reservoir fluid cavity 310 (labelled "T") that is configured to be fluidly coupled to the reservoir 206 via the reservoir port 110. The reservoir fluid cavity 310 is also configured as a dual-wing passage straddling a center passage. The rod fluid cavity 306 is interposed between the wings of the reservoir fluid cavity 310.

The valve assembly 100 also includes a solenoid fluid signal cavity 312 (labelled "SOL") that is fluidly coupled to an outlet port of the solenoid valve 120. In an example, when the solenoid valve 120 is unactuated (e.g., the solenoid coil of the solenoid valve 120 is de-energized), no pressure signal is provided to the solenoid fluid signal cavity 312. When the solenoid valve 120 is actuated (e.g., when a current or voltage command signal is provided by the controller 122 of the hydraulic system 200 to the solenoid coil of the solenoid valve 120 to energize it), a fluid pressure signal is provided to the solenoid fluid signal cavity 312. FIG. 3 depicts the valve assembly 100 in a state where the solenoid valve 120 is unactuated.

The main spool 116 is disposed, and is axially-movable, in a spool bore 314 within the housing 102. The main spool 116 comprises a cylindrical body that varies in diameter along its length to form lands of variable diameters capable of selectively interconnecting the various fluid passages respectively intercepting the spool bore 314 to control flow of fluid through the housing 102. Particularly, the main spool 116 has land 400, land 402, land 404, land 406, and land 408 separated by smaller diameter portions of the main spool 116. The lands 400-408 are configured to cooperate with the internal surfaces and fluid passages of the housing 102 to form variable orifices or fluid restrictions and control fluid flow rate and fluid direction through the housing 102. The variable orifices are spool-to-bore cylindrical area openings between the main spool 116 and the internal surfaces of the housing 102 that form when the main spool 116 shifts axially therein.

The main spool 116 is disposed between a first plug 316 and a second plug 318. The main spool 116 includes a first main spool cavity 320 at its first end proximate the first plug 316. The first main spool cavity 320 is fluidly coupled to the solenoid fluid signal cavity 312 via cross-hole 322 formed in the main spool 116. The term "cross-hole" indicates a hole that crosses a path of, or is formed transverse relative to, another hole, cavity, or channel.

The main spool 116 further includes a second main spool cavity 324 at its second end proximate the second plug 318. The second main spool cavity 324 contains nested springs including a firsts spring that can be referred to as an outer spring 326 and second spring that can be referred to as an inner spring 328 disposed partially within the outer spring 326.

Notably, in the example implementation in FIG. 3, the outer spring 326 and the inner spring 328 have different lengths. Particularly, the outer spring 326 is longer than the inner spring 328. Thus, while both the outer spring 326 and the inner spring 328 rest against the second plug 318 on one end, only the other end of the outer spring 326 rests against the inner surface of the main spool 116 whereas the other end of the inner spring 328 does not contact the main spool 116 when the solenoid valve 120 is unactuated. In other example implementations, however, this configuration can be reversed where the inner spring 328 is longer than the outer spring 326.

Further, the reservoir fluid cavity 310 is fluidly coupled to the second main spool cavity 324 via cross-hole 325 and internal channel 327. This way, the second main spool cavity 324 is filled with low pressure fluid.

The balancing spool 118 is disposed, and is axially-movable, in a spool bore 330 within the housing 102. The balancing spool 118 also comprises a cylindrical body that varies in diameter along its length to form lands of variable diameters capable of selectively interconnecting the various fluid passages respectively intercepting the spool bore 330 to control flow of fluid through the valve assembly 100. Particularly, the balancing spool 118 has land 410, land 412, and land 414 separated by smaller diameter portions of the balancing spool 118. The lands 410-414 are configured to cooperate with the internal surfaces and fluid passages of the housing 102 to form variable orifices or fluid restrictions and control fluid flow rate and fluid direction through the housing 102. The variable orifices are spool-to-bore cylindrical area openings between the balancing spool 118 and the internal surfaces of the housing 102 that form when the balancing spool 118 shifts axially therein.

The balancing spool 118 is disposed between a third plug 332 and a fourth plug 334. The balancing spool 118 includes a first balancing spool cavity 336 at its first end proximate the third plug 332. The first balancing spool cavity 336 is fluidly coupled to the head fluid cavity 304 via cross-hole 338 formed in the balancing spool 118. Further, the first balancing spool cavity 336 contains a spring 340 that has one end resting against the third plug 332 and another end resting against the balancing spool 118, thus applying a biasing force on the balancing spool 118 to the right in FIG. 3.

The balancing spool 118 also includes a second balancing spool cavity 342 at its second end proximate the fourth plug 334. The second balancing spool cavity 342 contains a spring 344 that has one end resting against the fourth plug 334 and another end resting against the balancing spool 118, thus applying a biasing force on the balancing spool 118 to the left in FIG. 3. The springs 340, 344 can be configured to apply substantially equal biasing forces on the balancing spool 118 in opposite directions.

The housing 102 further includes a first bridge fluid passage 346 (labelled "BR1") and a second bridge fluid passage 348 (labelled "BR2"). In the example shown in FIG. 3, the reservoir fluid cavity 310, the rod fluid cavity 306, and the bridge fluid passages 346, 348 are interposed between the wings of the accumulator fluid passage 300.

The bridge fluid passages 346, 348 operate as bridges that communicate fluid between the main spool 116 and the balancing spool 118, as described below. Also, the second bridge fluid passage 348 is fluidly coupled to the second balancing spool cavity 342 via a cross-hole 350.

The state of the valve assembly 100 shown in FIG. 3 corresponds to the unactuated state of the solenoid valve 120. In this state, no pressure signal is provided to the solenoid fluid signal cavity 312. As such, the outer spring 326 biases the main spool 116 to the left as shown in FIG. 3.

At such axial position of the main spool 116, the land 402 of the main spool 116 blocks fluid flow between the accumulator fluid passage 300 and the head fluid cavity 304. As such, the accumulator fluid passage 300 is fluidly decoupled from the head fluid cavity 304 (i.e., no fluid communication takes place therebetween). As depicted, the accumulator fluid passage 300 is fluidly coupled to the first bridge fluid passage 346 (the lands 402 and 404 do not block fluid flow between the accumulator fluid passage 300 and the first bridge fluid passage 346). However, the accumulator fluid passage 300 is fluidly decoupled from the second bridge fluid passage 348 by way of the land 408.

The term "fluidly coupled" is used herein to indicate that fluid can flow or be communicated between two fluid passages, chambers, ports, or openings. The term "fluidly decoupled" is used herein to mean that no substantial fluid flow (e.g., except for minimal leakage flow that can range from drops per minute to 300 milliliter per minute in some cases) occurs between two fluid passages, chambers, ports, or openings. Similarly, the term "block" is used throughout herein to indicate substantially preventing fluid flow except for minimal or leakage flow, for example.

Also, at the axial position of the main spool 116 shown in FIG. 3, the reservoir fluid cavity 310 is fluidly decoupled from the rod fluid cavity 306 by way of the land 406. However, the reservoir fluid cavity 310 is fluidly coupled to the second bridge fluid passage 348 (i.e., the right edge of the land 406 is positioned slightly past an undercut in the housing 102, and therefore the reservoir fluid cavity 310 is fluidly coupled to the second bridge fluid passage 348).

Because the accumulator fluid passage 300 is fluidly decoupled from the second bridge fluid passage 348 and the reservoir fluid cavity 310 is fluidly coupled to the second bridge fluid passage 348, fluid in the second bridge fluid passage 348 is a low pressure fluid. Such low pressure fluid is communicated to the second balancing spool cavity 342 via the cross-hole 350.

On the other hand, high pressure fluid from the head fluid cavity 304 is communicated via the cross-hole 338 to the first balancing spool cavity 336. As a result, the pressurized fluid in the first balancing spool cavity 336 applies a fluid force on the balancing spool 118, shifting it to the right to the position shown in FIG. 3 where the spring 344 is compressed.

At the axial position of the balancing spool 118 shown in FIG. 3, the supply fluid cavity 308 is fluidly coupled to the first bridge fluid passage 346 (i.e., the lands 410, 412 do not block fluid flow from the supply fluid cavity 308 to the first bridge fluid passage 346). As such, the source 204 charges the accumulator 202 by providing fluid through the supply fluid cavity 308, the first bridge fluid passage 346, then through the accumulator fluid passage 300 and the fluid passage 302 to the accumulator 202. This way, the balancing spool 118 allows the accumulator 202 to be charged to full supply pressure when the solenoid valve 120 is unactuated.

In the example implementation described herein, the solenoid valve 120 is configured as a proportional valve that can generate a fluid pressure signal having a pressure level that is proportional to a magnitude of the electric command (e.g., the magnitude of the voltage or current) provided by the controller 122 to the solenoid coil of the solenoid valve 120. For example, the solenoid valve 120 is configured as a pressure reducing valve that receives fluid at a particular pressure level (e.g., 120-300 psi) and generates a fluid pressure signal having a reduced pressure level (e.g., between 0 and 100 psi) based on a magnitude of the electric command signal to its solenoid coil.

As an example for illustration, when no signal is provided to the solenoid valve 120, no fluid pressure signal is generated therefrom. When the magnitude of the command signal from the controller 122 is about 40% of the maximum command, the solenoid valve 120 provides a fluid pressure signal having a pressure level of about 40 psi to shift the main spool 116 to a first actuated position and operate the valve assembly 100 in a first actuated state (see FIG. 4). When the magnitude of the command signal from the controller 122 is equal to the maximum command, the solenoid valve 120 provides a fluid pressure signal having a pressure level of about 100 psi to shift the main spool 116 to a second actuated position and operate the valve assembly 100 in a second actuated state (see FIG. 5). It should be understood that the numbers and percentages provided above are examples for illustration only.

FIG. 4 illustrates a cross-sectional view of the valve assembly 100 when the valve assembly 100 is actuated to a first actuated state, in accordance with an example implementation. The first actuated state corresponds to the controller 122 actuating the solenoid valve 120 to a first state. For example, the first state of the solenoid valve 120 corresponds to a command signal from the controller 122 having a magnitude of about 40%-50% of the maximum command.

In this first actuated state, a fluid pressure signal having a pressure level sufficient to overcome the biasing force of the outer spring 326 is provided to the solenoid fluid signal cavity 312. For example, the pressure level of the fluid pressure signal can be about 40 psi. As a result, the main spool 116 moves to the right to the axial position shown in FIG. 4 where it contacts the inner spring 328. The combined biasing forces of the outer spring 326 and the inner spring 328 balance the fluid force of fluid in the solenoid fluid signal cavity 312, and the main spool 116 stops at the axial position shown in FIG. 4. In other words, the main spool 116 shifts axially by a portion of its full stroke.

At the axial position of the main spool 116 shown in FIG. 4, the accumulator fluid passage 300 remains fluidly decoupled from the head fluid cavity 304 (i.e., no fluid communication takes place therebetween) by way of the land 402. Also, the accumulator fluid passage 300 remains fluidly coupled to the first bridge fluid passage 346. Further, the accumulator fluid passage 300 becomes also fluidly coupled to the second bridge fluid passage 348 as the land 408 of the main spool 116 shifts past an edge of the wing of the accumulator fluid passage 300 proximate the second bridge fluid passage 348.

Also, at the axial position of the main spool 116 shown in FIG. 4, the reservoir fluid cavity 310 remains fluidly decoupled from the rod fluid cavity 306 by way of the land 406. The reservoir fluid cavity 310 becomes also fluidly decoupled from the second bridge fluid passage 348 by way of the land 406.

Thus, at the first actuated state shown in FIG. 4, the accumulator fluid passage 300 is fluidly coupled to the second bridge fluid passage 348 while the reservoir fluid cavity 310 is fluidly decoupled from the second bridge fluid passage 348. This way, pressurized fluid from the accumulator 202 is communicated to the second balancing spool cavity 342 via the cross-hole 350. On the other hand, high pressure fluid from the head fluid cavity 304 is communicated via the cross-hole 338 to the first balancing spool cavity 336.

With this configuration, in the first actuated state shown in FIG. 4, the valve assembly 100 operates in a balancing mode that equalizes pressure level in the head fluid cavity 304 and the accumulator fluid passage 300, thereby equalizing pressure level between the accumulator 202 and the head-side chamber 214 of the hydraulic cylinder actuator 208. Particularly, pressurized fluid from the accumulator 202 is communicated to the second balancing spool cavity 342 and applies a fluid force on the balancing spool 118 to the left in FIG. 4. On the other hand, pressurized fluid from the head fluid cavity 304 is communicated via the cross-hole 338 to the first balancing spool cavity 336 and applies a respective fluid force on the balancing spool 118 to the right in FIG. 4. This way, the balancing spool 118 is subjected to opposing fluid forces by fluid from the head fluid cavity 304 and fluid from the accumulator fluid passage 300.

This configuration causes the pressure levels in the first balancing spool cavity 336 and the second balancing spool cavity 342 to substantially equalize, i.e., causes pressure level of the accumulator 202 to be balanced with pressure level in the head-side chamber 214. The term "balanced" is used herein to indicate that the pressure levels are substantially equalized, e.g., pressure levels are within 0-3% of each other.

If pressure level in the first balancing spool cavity 336 is higher than the pressure level in the second balancing spool cavity 342, the balancing spool 118 moves to the right. As a result, the supply fluid cavity 308 can be fluidly reconnected with the first bridge fluid passage 346 (i.e., the land 412 no longer blocks fluid flow therebetween), causing the accumulator 202 to be charged and the pressure level in the second balancing spool cavity 342 to increase, thus pushing the balancing spool 118 back to the left in FIG. 4.

On the other hand, if pressure level in the second balancing spool cavity 342 is higher than the pressure level in the first balancing spool cavity 336, the balancing spool 118 moves to the left. As a result, the first bridge fluid passage 346 may be fluidly connected to the reservoir fluid cavity 310 (i.e., the land 412 does not block fluid flow therebetween), relieving pressurized fluid in the accumulator fluid passage 300 and reducing the pressure level in the second balancing spool cavity 342, thus causing the balancing spool 118 to move back to the right in FIG. 4.

As such, the balancing spool 118 "dithers" or can move back and forth to maintain balancing of pressure levels between the head fluid cavity 304 and the accumulator fluid passage 300. Thus, pressure levels are equalized between the head-side chamber 214 and the accumulator 202.

The controller 122 of the hydraulic system 200 can maintain the valve assembly 100 operating in the first actuated state of FIG. 4 for a particular period of time, e.g., 2 seconds. During such period of time, pressure levels are equalized between the head-side chamber 214 and the accumulator 202, and the valve assembly 100 is ready to operate in an oscillation control mode by operating the valve assembly 100 in a second actuated state. Particularly, the controller 122 can increase the magnitude of the command signal to the solenoid valve 120 to increase pressure level of the fluid pressure signal provided to the solenoid fluid signal cavity 312 and shift the main spool 116 further to the right to a second actuated position shown in FIG. 5.

FIG. 5 illustrates a cross-sectional view of the valve assembly 100 when the valve assembly 100 is actuated to a second actuated state, in accordance with an example implementation. The second actuated state corresponds to the controller 122 actuating the solenoid valve 120 to a second state. For example, the second state of the solenoid valve 120 corresponds to a command signal from the controller 122 having a magnitude of about 80%-100% of the maximum command. In the second actuated state of the valve assembly 100 corresponding to the second state of the solenoid valve 120, the valve assembly 100 operates in an oscillation control or "ride control" mode.

In the oscillation control mode, it is desirable to absorb and dampen oscillations of the hydraulic cylinder actuator 208. To dampen oscillations of the hydraulic cylinder actuator 208, the valve assembly 100 is configured to allow fluid communication between the head-side chamber 214 of the hydraulic cylinder actuator 208 and the accumulator 202 via fluid restriction. Further the valve assembly 100 allows fluid in the rod-side chamber 216 to be vented to the reservoir 206, thus allowing the piston 212 to move slightly as the accumulator 202 absorbs and dampens motion of the piston 212.

Referring to FIG. 5, in this second actuated state, the main spool 116 is fully shifted to the right as a result of an increase in pressure level of the fluid pressure signal provided to the solenoid fluid signal cavity 312 (e.g., an increase from 40 psi to 100 psi). The increase in pressure level of the fluid pressure signal increases the fluid force acting on the main spool 116, overcoming the combined biasing forces of the outer spring 326 and the inner spring 328 and shifting the main spool 116 further to the right to the axial position shown in FIG. 5.

At the axial position of the main spool 116 shown in FIG. 5, the accumulator fluid passage 300 becomes fluidly coupled to the head fluid cavity 304 as the land 402 moves past a left edge of the accumulator fluid passage 300, thereby allowing for fluid communication between the head-side chamber 214 and the accumulator 202. The opening between the left edge of the land 402 and the left edge of the accumulator fluid passage 300 operates an orifice or flow restriction that facilitates dampening motion of the piston 212 as the accumulator 202 absorbs energy. Also, the accumulator fluid passage 300 becomes fluidly decoupled from the first bridge fluid passage 346, and remains fluidly coupled to the second bridge fluid passage 348.

At the axial position of the balancing spool 118 shown in FIG. 5, the supply fluid cavity 308 is fluidly decoupled from the first bridge fluid passage 346 and flow from the source 204 is blocked by the land 412. Also, the land 402 of the main spool 116 blocks fluid flow from the supply fluid cavity 308 through the first bridge fluid passage 346 to the accumulator fluid passage 300. As such, the accumulator 202 is not charged when the valve assembly 100 operates in the second actuated state (i.e., when the valve assembly 100 operates in the oscillation control mode). Rather, the balancing spool 118 blocks fluid flow from the supply fluid cavity 308 to the first bridge fluid passage 346.

Further, at the axial position of the main spool 116 shown in FIG. 5, the reservoir fluid cavity 310 becomes fluidly coupled to the rod fluid cavity 306, thereby allowing the rod fluid cavity 306 (and the rod-side chamber 216) to be vented to the reservoir 206 and allowing the piston 212 to move. However, the reservoir fluid cavity 310 remains fluidly decoupled from the second bridge fluid passage 348.

Thus, in the second actuated state, the valve assembly 100 operates in an oscillation control mode where it allows fluid communication between the head-side chamber 214 and the accumulator 202, and allows the rod-side chamber 216 to be vented to the reservoir 206. This way, the piston 212 is allowed to move as the valve assembly 100 and the accumulator 202 absorb and dampen motion of the piston 212, and reduce any oscillations.

Thus, referring to the three modes of operation depicted respectively in FIGS. 3-5, the valve assembly 100 is configured to: (i) charge the accumulator 202 to full supply pressure level when the solenoid valve 120 is unactuated, (ii) allow the pressure level at the head-side chamber 214 to be equalized with the pressure level in the accumulator 202 when the solenoid valve 120 is actuated to the first state, thereby precluding unintentional movement of the piston 212 when the accumulator 202 is fluidly coupled to the head-side chamber 214, and (iii) fluidly couple the head-side chamber 214 to the accumulator 202 and fluidly couple the rod-side chamber 216 to the reservoir 206 when the solenoid valve 120 is actuated to the second state.

The valve assembly 100 may provide several advantages over conventional systems. For example, conventional systems involve continually charging and discharging the accumulator, rendering the system inefficient. Also, the solenoid valve 120 can operate by providing fluid pressure signals in the 0-100 psi range, and can thus be operated by receiving an input fluid signal that has a reduced pressure level (e.g., 120-300 psi) compared to full system pressure level of 3000-5000 psi. As such, the solenoid valve 120 need not be configured to withstand system pressure levels, thus reducing it cost. Further, one solenoid valve (i.e., the solenoid valve 120) is used to control positions of both the main spool 116 and the balancing spool 118 as opposed to using a respective solenoid valve for each spool, thereby reducing complexity and cost of the valve assembly 100 compared to a system with two solenoid valves.

In examples, the initiation of spool movement of the main spool 116 to the various states or positions may utilize external controlling elements, sensing elements, timing sequence, or other means, such as to increase the overall system efficiency in contrast with a system, which does not include the valve assembly 100 disclosed herein, that allows continual fluid flow and charging and discharging of the accumulator 202. Thus, the disclosed valve assembly and system is an efficient system that may be turned on and off, and is configured to reduce total energy consumption, waste heat, etc.

Figure 6:
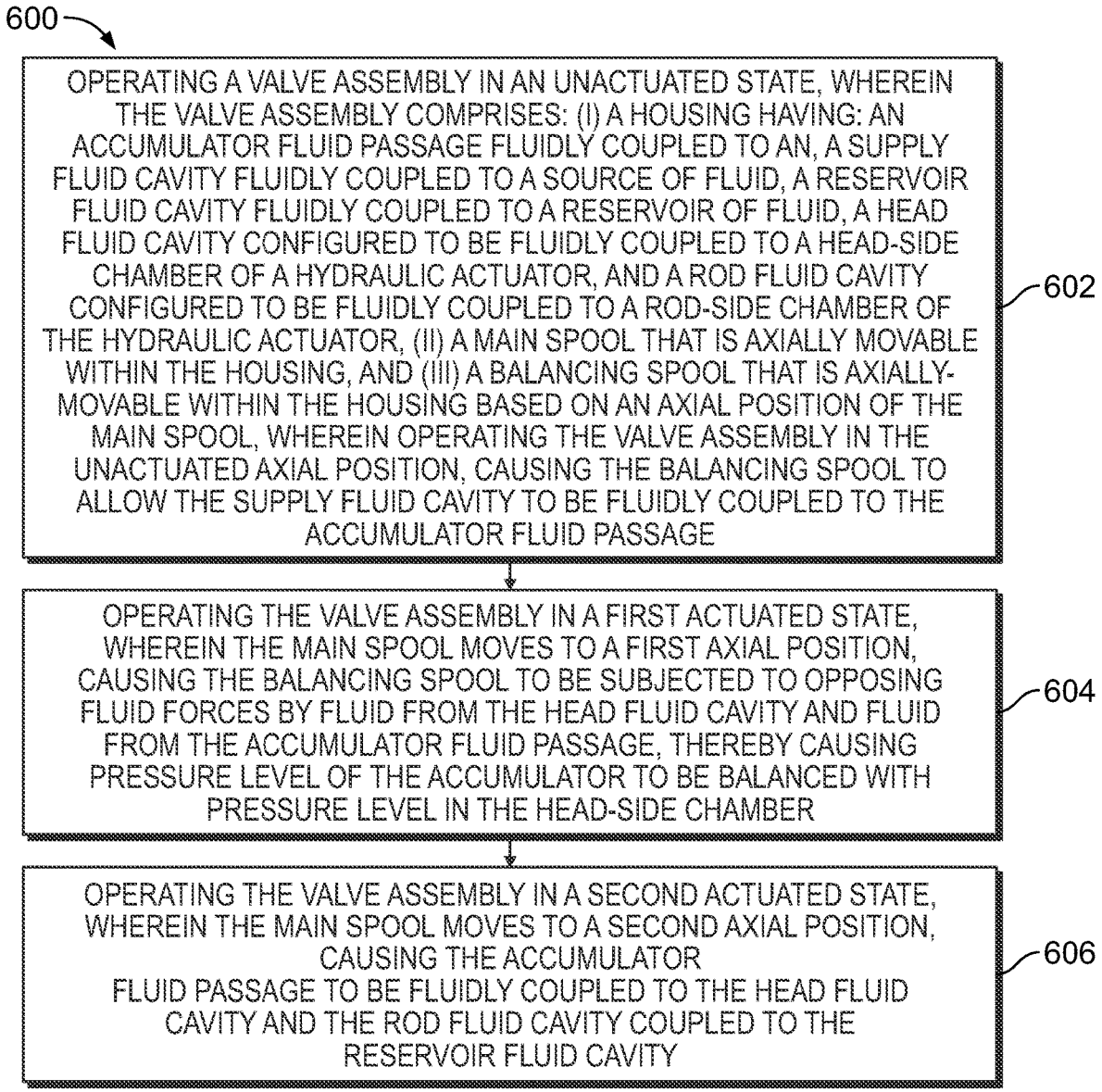
FIG. 6 is a flowchart of a method for operating a valve assembly, in accordance with an example implementation.

FIG. 6 is a flowchart of a method 600 for operating a valve assembly, in accordance with an example implementation. For example, the method 600 can be implemented by the controller 122 for operating the valve assembly 100 of the hydraulic system 200. The method 600 can be implemented by the controller 122, for instance.

The method 600 may include one or more operations, or actions as illustrated by one or more of blocks 602-606 and 700-702. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 602, the method 600 includes operating the valve assembly 100 in an unactuated state. As described above, the valve assembly 100 comprises: (i) the housing 102 having: the accumulator fluid passage 300 fluidly coupled to the accumulator 202, the supply fluid cavity 308 fluidly coupled to the source 204 of fluid, the reservoir fluid cavity 310 fluidly coupled to the reservoir 206 of fluid, the head fluid cavity 304 configured to be fluidly coupled to the head-side chamber 214 of the hydraulic cylinder actuator 208, and the rod fluid cavity 306 configured to be fluidly coupled to the rod-side chamber 216 of the hydraulic cylinder actuator 208, (ii) the main spool 116 that is axially-movable within the housing 102, and (iii) the balancing spool 118 that is axially-movable within the housing 102 based on an axial position of the main spool 116. Operating the valve assembly 100 in the unactuated state comprises the main spool 116 being at an unactuated axial position, causing the balancing spool 118 to allow the supply fluid cavity 308 to be fluidly coupled to the accumulator fluid passage 300.

At block 604, the method 600 includes operating the valve assembly 100 in a first actuated state, wherein the main spool 116 moves to a first axial position, causing the balancing spool 118 to be subjected to opposing fluid forces by fluid from the head fluid cavity 304 and fluid from the accumulator fluid passage 300, thereby causing pressure level of the accumulator 202 to be balanced with pressure level in the head-side chamber 214.

At block 606, the method 600 includes operating the valve assembly 100 in a second actuated state, wherein the main spool 116 moves to a second axial position, causing the accumulator fluid passage 300 to be fluidly coupled to the head fluid cavity 304 and the rod fluid cavity 306 to be fluidly coupled to the reservoir fluid cavity 310.

Figure 7:
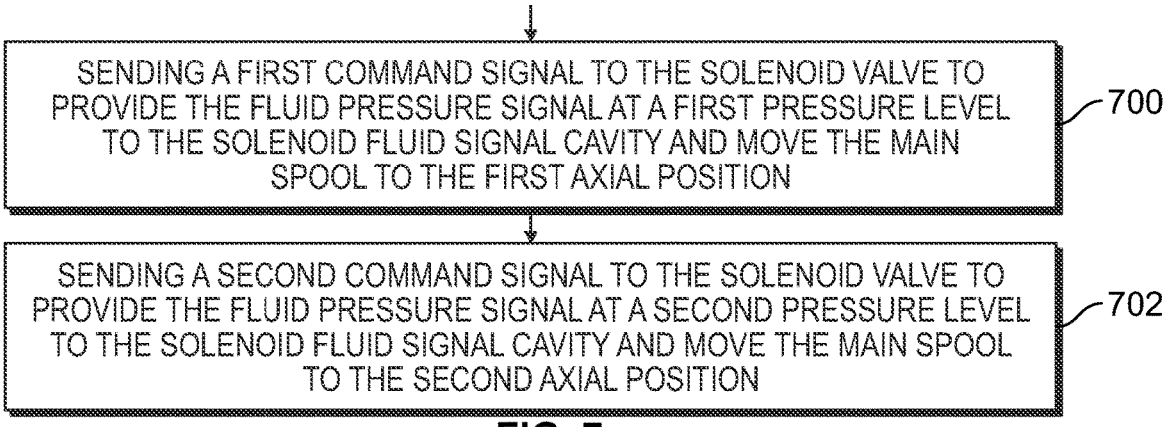
FIG. 7 is a flowchart of additional operations that are executable with the method of FIG. 6, in accordance with an example implementation

FIG. 7 is a flowchart of additional operations that are executable with the method 600 of FIG. 6, in accordance with an example implementation. The valve assembly 100 can further include the solenoid valve 120 coupled to the housing 102 and the housing further includes the solenoid fluid signal cavity 312 fluidly coupled to the solenoid valve 120. As described above, the main spool 116 is axially-movable within the housing 102 based on pressure level of a fluid pressure signal received in the solenoid fluid signal cavity 312 from the solenoid valve 120.

At block 700, operations include sending a first command signal to the solenoid valve 120 to provide the fluid pressure signal at a first pressure level to the solenoid fluid signal cavity 312 and move the main spool 116 to the first axial position, operating the valve assembly in the first actuated state.

At block 702, operations include sending a second command signal to the solenoid valve 120 to provide the fluid pressure signal at a second pressure level to the solenoid fluid signal cavity 312 and move the main spool 116 to the second axial position, operating the valve assembly 100 in the second actuated state.

The method 600 can further include any of the operations described throughout the disclosure.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" or "about" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

Embodiments of the present disclosure can thus relate to one of the enumerated example embodiment (EEEs) listed below.

EEE 1 is a valve assembly comprising: a housing comprising: (i) an accumulator fluid passage configured to be fluidly coupled to an accumulator, (ii) a supply fluid cavity configured to be fluidly coupled to a source of fluid, (iii) a reservoir fluid cavity configured to be fluidly coupled to a reservoir of fluid, (iv) a head fluid cavity configured to be fluidly coupled to a head-side chamber of a hydraulic actuator, and (v) a rod fluid cavity configured to be fluidly coupled to a rod-side chamber of the hydraulic actuator; a main spool that is axially-movable within the housing between an unactuated axial position, a first axial position, and a second axial position; and a balancing spool that is axially-movable within the housing based on an axial position of the main spool, wherein (i) when the main spool is at the unactuated axial position, the balancing spool allows the supply fluid cavity to be fluidly coupled to the accumulator fluid passage, (ii) when the main spool is at the first axial position, the balancing spool is subjected to opposing fluid forces by fluid from the head fluid cavity and fluid from the accumulator fluid passage, thereby causing pressure level in the accumulator fluid passage to be balanced with pressure level in the head fluid cavity, and (iii) when the main spool is at the second axial position, the main spool allows the accumulator fluid passage to be fluidly coupled to the head fluid cavity and the rod fluid cavity to be fluidly coupled to the reservoir fluid cavity.

EEE 2 is the valve assembly of EEE 1, further comprising: a solenoid valve coupled to the housing, wherein the housing further comprises a solenoid fluid signal cavity fluidly coupled to the solenoid valve, wherein the main spool is axially-movable within the housing based on pressure level of a fluid pressure signal received in the solenoid fluid signal cavity from the solenoid valve.

EEE 3 is the valve assembly of any of EEEs 1-2, wherein the main spool moves to the first axial position when the solenoid valve is actuated to a first state, providing the fluid pressure signal at a first pressure level to the solenoid fluid signal cavity, and wherein the main spool moves to the second axial position when the solenoid valve is actuated to a second state, providing the fluid pressure signal at a second pressure level to the solenoid fluid signal cavity.

EEE 4 is the valve assembly of EEE 3, wherein the second pressure level is larger than the first pressure level.

EEE 5 is the valve assembly of any of EEEs 1-4, wherein the fluid pressure signal applies a fluid force on the main spool in a first direction, wherein the valve assembly further comprises: at least one spring applying a biasing force on the main spool in a second direction opposite the first direction, such that the axial position of the main spool is based on the fluid force and the biasing force.

EEE 6 is the valve assembly of EEE 5, wherein the at least one spring comprises nested springs comprising: an outer spring applying a first biasing force on the main spool; and an inner spring disposed, at least partially, within the outer spring and applying a second biasing force on the main spool, wherein the outer spring and the inner spring have different lengths such that the main spool engages one of the outer spring or the inner spring when the main spool is moving from the unactuated axial position to the first axial position and engages both the outer spring and the inner spring when moving from the first axial position to the second axial position.

EEE 7 is the valve assembly of any of EEEs 1-6, wherein when the main spool is at the first axial position, fluid from the head fluid cavity is communicated to a first end of the balancing spool and fluid from the accumulator fluid passage is communicated to a second end of the balancing spool, thereby causing the balancing spool to be subjected to the opposing fluid forces by fluid from the head fluid cavity and fluid from the accumulator fluid passage.

EEE 8 is the valve assembly of any of EEEs 1-7, further comprising: a first spring applying a first biasing force on the balancing spool in a first direction; and a second spring applying a second biasing force on the balancing spool in a second direction opposite the first direction.

EEE 9 is the valve assembly of any of EEEs 1-8, wherein when the main spool is at the second axial position, the main spool blocks fluid flow from the supply fluid cavity to the accumulator fluid passage.

EEE 10 is the valve assembly of any of EEEs 1-9, wherein the housing further comprises: a bridge fluid passage configured to fluidly couple the supply fluid cavity to the accumulator fluid passage when the main spool is in the unactuated axial position.

EEE 11 is the valve assembly of EEE 10, wherein the bridge fluid passage is a first bridge fluid passage, wherein the housing further comprises a second bridge fluid passage configured to fluidly couple the reservoir fluid cavity to an end of the balancing spool when the main spool is in the unactuated axial position, while fluidly coupling the accumulator fluid passage to the end of the balancing spool when the main spool is in the first axial position.

EEE 12 is a hydraulic system comprising: a source of fluid; a reservoir of fluid; a hydraulic cylinder actuator having a head-side chamber and a rod-side chamber; an accumulator; and a valve assembly comprising: a housing comprising: (i) an accumulator fluid passage fluidly coupled to the accumulator, (ii) a supply fluid cavity fluidly coupled to the source of fluid, (iii) a reservoir fluid cavity fluidly coupled to the reservoir of fluid, (iv) a head fluid cavity configured to be fluidly coupled to the head-side chamber, and (v) a rod fluid cavity configured to be fluidly coupled to the rod-side chamber, a main spool that is axially-movable within the housing between an unactuated axial position, a first axial position, and a second axial position, and a balancing spool that is axially-movable within the housing based on an axial position of the main spool, wherein (i) when the main spool is at the unactuated axial position, the balancing spool allows the supply fluid cavity to be fluidly coupled to the accumulator fluid passage, (ii) when the main spool is at the first axial position, the balancing spool is subjected to opposing fluid forces by fluid from the head fluid cavity and fluid from the accumulator fluid passage, thereby causing pressure level of the accumulator to be balanced with pressure level in the head-side chamber, and (iii) when the main spool is at the second axial position, the main spool allows the accumulator fluid passage to be fluidly coupled to the head fluid cavity and the rod fluid cavity to be fluidly coupled to the reservoir fluid cavity.

EEE 13 is the hydraulic system of EEE 12, further comprising: a solenoid valve coupled to the housing, wherein the housing further comprises a solenoid fluid signal cavity fluidly coupled to the solenoid valve, wherein the main spool is axially-movable within the housing based on pressure level of a fluid pressure signal received in the solenoid fluid signal cavity from the solenoid valve.

EEE 14 is the hydraulic system of EEE 13, further comprising: a controller configured to send a command signal to the solenoid valve to provide the fluid pressure signal to the solenoid fluid signal cavity, wherein the controller sends: a first command signal to the solenoid valve to provide the fluid pressure signal at a first pressure level to the solenoid fluid signal cavity and move the main spool to the first axial position, and a second command signal to the solenoid valve to provide the fluid pressure signal at a second pressure level to the solenoid fluid signal cavity and move the main spool to the second axial position, wherein the second pressure level is larger than the first pressure level.

EEE 15 is the hydraulic system of any of EEEs 13-14, wherein the fluid pressure signal applies a fluid force on the main spool in a first direction, wherein the valve assembly further comprises: at least one spring applying a biasing force on the main spool in a second direction opposite the first direction, such that the axial position of the main spool is based on the fluid force and the biasing force.

EEE 16 is the hydraulic system of EEE 15, wherein the at least one spring comprises nested springs comprising: an outer spring applying a first biasing force on the main spool; and an inner spring disposed, at least partially, within the outer spring and applying a second biasing force on the main spool, wherein the outer spring and the inner spring have different lengths such that the main spool engages one of the outer spring or the inner spring when the main spool is moving from the unactuated axial position to the first axial position and engages both the outer spring and the inner spring when moving from the first axial position to the second axial position.

EEE 17 is the hydraulic system of any of EEEs 12-16, wherein when the main spool is at the first axial position, fluid from the head fluid cavity is communicated to a first end of the balancing spool and fluid from the accumulator fluid passage is communicated to a second end of the balancing spool, thereby causing the balancing spool to be subjected to the opposing fluid forces by fluid from the head fluid cavity and fluid from the accumulator fluid passage.

EEE 18 is the hydraulic system of any of EEEs 12-17, wherein the valve assembly further comprises: a first spring applying a first biasing force on the balancing spool in a first direction; and a second spring applying a second biasing force on the balancing spool in a second direction opposite the first direction.

EEE 19 is the hydraulic system of any of EEEs 12-18, wherein when the main spool is at the second axial position, the main spool blocks fluid flow from the supply fluid cavity to the accumulator fluid passage.

EEE 20 is a method comprising: operating a valve assembly in an unactuated state, wherein the valve assembly comprises: (i) a housing having: an accumulator fluid passage fluidly coupled to an accumulator, a supply fluid cavity fluidly coupled to a source of fluid, a reservoir fluid cavity fluidly coupled to a reservoir of fluid, a head fluid cavity configured to be fluidly coupled to a head-side chamber of a hydraulic actuator, and a rod fluid cavity configured to be fluidly coupled to a rod-side chamber of the hydraulic actuator, (ii) a main spool that is axially-movable within the housing, and (iii) a balancing spool that is axially-movable within the housing based on an axial position of the main spool, wherein operating the valve assembly in the unactuated state comprises the main spool being at an unactuated axial position, causing the balancing spool to allow the supply fluid cavity to be fluidly coupled to the accumulator fluid passage; operating the valve assembly in a first actuated state, wherein the main spool moves to a first axial position, causing the balancing spool to be subjected to opposing fluid forces by fluid from the head fluid cavity and fluid from the accumulator fluid passage, thereby causing pressure level of the accumulator to be balanced with pressure level in the head-side chamber; and operating the valve assembly in a second actuated state, wherein the main spool moves to a second axial position, causing accumulator fluid passage to be fluidly coupled to the head fluid cavity and the rod fluid cavity to be fluidly coupled to the reservoir fluid cavity.

EEE 21 is the method of EEE 20, wherein the valve assembly further comprises a solenoid valve coupled to the housing, wherein the housing further comprises a solenoid fluid signal cavity fluidly coupled to the solenoid valve, wherein the main spool is axially-movable within the housing based on pressure level of a fluid pressure signal received in the solenoid fluid signal cavity from the solenoid valve, and wherein: operating the valve assembly in the first actuated state comprises sending a first command signal to the solenoid valve to provide the fluid pressure signal at a first pressure level to the solenoid fluid signal cavity and move the main spool to the first axial position, and operating the valve assembly in the second actuated state comprises sending a second command signal to the solenoid valve to provide the fluid pressure signal at a second pressure level to the solenoid fluid signal cavity and move the main spool to the second axial position.

What is claimed is:

1. A valve assembly comprising:

a housing comprising: (i) an accumulator fluid passage configured to be fluidly coupled to an accumulator, (ii) a supply fluid cavity configured to be fluidly coupled to a source of fluid, and (iii) a head fluid cavity configured to be fluidly coupled to a head-side chamber of a hydraulic actuator;

a main spool that is axially-movable within the housing between an unactuated axial position, a first axial position, and a second axial position; and a balancing spool that is axially-movable within the housing based on an axial position of the main spool, wherein (i) when the main spool is at the unactuated axial position, the balancing spool allows the supply fluid cavity to be fluidly coupled to the accumulator fluid passage, (ii) when the main spool is at the first axial position, the balancing spool allows pressure level in the accumulator fluid passage to be balanced with pressure level in the head fluid cavity, and (iii) when the main spool is at the second axial position, the main spool allows the accumulator fluid passage to be fluidly coupled to the head fluid cavity.

2. The valve assembly of claim 1, further comprising:

a solenoid valve coupled to the housing, wherein the housing further comprises a solenoid fluid signal cavity fluidly coupled to the solenoid valve, wherein the main spool is axially-movable within the housing based on pressure level of a fluid pressure signal received in the solenoid fluid signal cavity from the solenoid valve.

3. The valve assembly of claim 2, wherein the main spool moves to the first axial position when the solenoid valve is actuated to a first state, providing the fluid pressure signal at a first pressure level to the solenoid fluid signal cavity, and wherein the main spool moves to the second axial position when the solenoid valve is actuated to a second state, providing the fluid pressure signal at a second pressure level to the solenoid fluid signal cavity.

4. The valve assembly of claim 3, wherein the second pressure level is larger than the first pressure level.

5. The valve assembly of claim 2, wherein the fluid pressure signal applies a fluid force on the main spool in a first direction, wherein the valve assembly further comprises:

at least one spring applying a biasing force on the main spool in a second direction opposite the first direction, such that the axial position of the main spool is based on the fluid force and the biasing force.

6. The valve assembly of claim 5, wherein the at least one spring comprises nested springs comprising:

a first spring applying a first biasing force on the main spool; and a second spring applying a second biasing force on the main spool, wherein the first spring and the second spring have different lengths such that the main spool engages one of the first spring or the second spring when the main spool is moving from the unactuated axial position to the first axial position and engages both the first spring and the second spring when moving from the first axial position to the second axial position.

7. The valve assembly of claim 1, wherein when the main spool is at the first axial position, fluid from the head fluid cavity is communicated to a first end of the balancing spool and fluid from the accumulator fluid passage is communicated to a second end of the balancing spool, thereby causing the balancing spool to be subjected to opposing fluid forces by fluid from the head fluid cavity and fluid from the accumulator fluid passage, thereby causing the pressure level in the accumulator fluid passage to be balanced with the pressure level in the head fluid cavity.

8. The valve assembly of claim 1, further comprising:

a first spring applying a first biasing force on the balancing spool in a first direction; and a second spring applying a second biasing force on the balancing spool in a second direction opposite the first direction.

9. The valve assembly of claim 1, wherein when the main spool is at the second axial position, the main spool blocks fluid flow from the supply fluid cavity to the accumulator fluid passage.

10. The valve assembly of claim 1, wherein the housing further comprises:

a bridge fluid passage configured to fluidly couple the supply fluid cavity to the accumulator fluid passage when the main spool is in the unactuated axial position.

11. The valve assembly of claim 10, wherein the bridge fluid passage is a first fluid passage, wherein the housing further comprises:

a second bridge fluid passage configured to fluidly couple the reservoir fluid cavity to an end of the balancing spool when the main spool is in the unactuated axial position, while fluidly coupling the accumulator fluid passage to the end of the balancing spool when the main spool is in the first axial position.

12. A hydraulic system comprising:

a source of fluid;

a reservoir of fluid;

a hydraulic cylinder actuator having a head-side chamber and a rod-side chamber;

an accumulator; and a valve assembly comprising:

a housing comprising: (i) an accumulator fluid passage fluidly coupled to the accumulator, (ii) a supply fluid cavity fluidly coupled to the source of fluid, and (iii) a head fluid cavity configured to be fluidly coupled to the head-side chamber, a main spool that is axially-movable within the housing between an unactuated axial position, a first axial position, and a second axial position, and a balancing spool that is axially-movable within the housing based on an axial position of the main spool, wherein (i) when the main spool is at the unactuated axial position, the balancing spool allows the supply fluid cavity to be fluidly coupled to the accumulator fluid passage, (ii) when the main spool is at the first axial position, the balancing spool allows pressure level of the accumulator to be balanced with pressure level in the head-side chamber, and (iii) when the main spool is at the second axial position, the main spool allows the accumulator fluid passage to be fluidly coupled to the head fluid cavity.

13. The hydraulic system of claim 12, further comprising:

a solenoid valve coupled to the housing, wherein the housing further comprises a solenoid fluid signal cavity fluidly coupled to the solenoid valve, wherein the main spool is axially-movable within the housing based on pressure level of a fluid pressure signal received in the solenoid fluid signal cavity from the solenoid valve.

14. The hydraulic system of claim 13, further comprising:

a controller configured to send a command signal to the solenoid valve to provide the fluid pressure signal to the solenoid fluid signal cavity, wherein the controller sends:

a first command signal to the solenoid valve to provide the fluid pressure signal at a first pressure level to the solenoid fluid signal cavity and move the main spool to the first axial position, and a second command signal to the solenoid valve to provide the fluid pressure signal at a second pressure level to the solenoid fluid signal cavity and move the main spool to the second axial position, wherein the second pressure level is larger than the first pressure level.

15. The hydraulic system of claim 13, wherein the fluid pressure signal applies a fluid force on the main spool in a first direction, wherein the valve assembly further comprises:

at least one spring applying a biasing force on the main spool in a second direction opposite the first direction, such that the axial position of the main spool is based on the fluid force and the biasing force.

16. The hydraulic system of claim 15, wherein the at least one spring comprises nested springs comprising:

a first spring applying a first biasing force on the main spool; and a second spring applying a second biasing force on the main spool, wherein the first and the second have different lengths such that the main spool engages one of the first spring or the second when the main spool is moving from the unactuated axial position to the first axial position and engages both the first spring and the second spring when moving from the first axial position to the second axial position.

17. The hydraulic system of claim 12, wherein when the main spool is at the first axial position, fluid from the head fluid cavity is communicated to a first end of the balancing spool and fluid from the accumulator fluid passage is communicated to a second end of the balancing spool, thereby causing the balancing spool to be subjected to opposing fluid forces by fluid from the head fluid cavity and fluid from the accumulator fluid passage, thereby causing the pressure level in the accumulator fluid passage to be balanced with the pressure level in the head fluid cavity.

18. The hydraulic system of claim 12, wherein when the main spool is at the second axial position, the main spool blocks fluid flow from the supply fluid cavity to the accumulator fluid passage.

19. A method comprising:

operating a valve assembly in an unactuated state, wherein the valve assembly comprises: (i) a housing having: an accumulator fluid passage fluidly coupled to an accumulator, a supply fluid cavity fluidly coupled to a source of fluid, and a head fluid cavity configured to be fluidly coupled to a head-side chamber of a hydraulic actuator, (ii) a main spool that is axially-movable within the housing, and (iii) a balancing spool that is axially-movable within the housing based on an axial position of the main spool, wherein operating the valve assembly in the unactuated state comprises the main spool being at an unactuated axial position, causing the balancing spool to allow the supply fluid cavity to be fluidly coupled to the accumulator fluid passage;

operating the valve assembly in a first actuated state, wherein the main spool moves to a first axial position, causing the balancing spool to allow pressure level of the accumulator to be balanced with pressure level in the head-side chamber; and operating the valve assembly in a second actuated state, wherein the main spool moves to a second axial position, causing the accumulator fluid passage to be fluidly coupled to the head fluid cavity.

20. The method of claim 19, wherein the valve assembly further comprises a solenoid valve coupled to the housing, wherein the housing further comprises a solenoid fluid signal cavity fluidly coupled to the solenoid valve, wherein the main spool is axially-movable within the housing based on pressure level of a fluid pressure signal received in the solenoid fluid signal cavity from the solenoid valve, and wherein:

operating the valve assembly in the first actuated state comprises sending a first command signal to the solenoid valve to provide the fluid pressure signal at a first pressure level to the solenoid fluid signal cavity and move the main spool to the first axial position, and operating the valve assembly in the second actuated state comprises sending a second command signal to the solenoid valve to provide the fluid pressure signal at a second pressure level to the solenoid fluid signal cavity and move the main spool to the second axial position.

* * * * *